US010329897B2

(12) United States Patent
Kona et al.

(10) Patent No.: US 10,329,897 B2
(45) Date of Patent: Jun. 25, 2019

(54) SYSTEM FOR DETERMINATION OF MEASURED DEPTH (MD) IN WELLBORES FROM DOWNHOLE PRESSURE SENSORS USING TIME OF ARRIVAL TECHNIQUES

(71) Applicant: HRL Laboratories, LLC, Malibu, CA (US)

(72) Inventors: Keerti S. Kona, Woodland Hills, CA (US); Logan D. Sorenson, Thousand Oaks, CA (US); Raviv Perahia, Agoura Hills, CA (US); Hung Nguyen, Los Angeles, CA (US); David Chang, Calabasas, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 15/881,700

(22) Filed: Jan. 26, 2018

(65) Prior Publication Data

US 2018/0274355 A1 Sep. 27, 2018

Related U.S. Application Data

(60) Provisional application No. 62/477,344, filed on Mar. 27, 2017.

(51) Int. Cl.

| | |
|---|---|
| ***E21B 47/04*** | (2012.01) |
| ***E21B 47/06*** | (2012.01) |
| ***E21B 47/18*** | (2012.01) |
| ***E21B 47/022*** | (2012.01) |

(52) U.S. Cl.

CPC ..... *E21B 47/04* (2013.01); *E21B 47/06* (2013.01); *E21B 47/065* (2013.01); *E21B 47/18* (2013.01); *E21B 47/02208* (2013.01)

(58) Field of Classification Search

CPC ..... E21B 45/00; E21B 47/16; G01V 11/002

(Continued)

(56) References Cited

U.S. PATENT DOCUMENTS 4,454,756 A 6/1984 Sharp
4,542,647 A 9/1985 Molnar (Continued)

OTHER PUBLICATIONS

Notification of Transmittal of International Search Report and the Written Opinion of the International Searching Authority for PCT/US2018/015612; dated May 9, 2018.

(Continued)

*Primary Examiner* — Fabricio R Murillo Garcia

(74) *Attorney, Agent, or Firm* — Tope-McKay & Associates

(57) ABSTRACT

Described is a system for estimating measured depth of a borehole. The system comprises a drilling fluid pulse telemetry system positioned in a borehole and processors connected with the drilling fluid pulse telemetry system. Time series measures are obtained from an environmental sensor package. Initial estimates of a time delay and path attenuation amplitude are determined. An error for the initial estimates is determined, and iterative minimization of the error is performed until source signal parameters converge, resulting in a least squares estimate of the source signal and the reflected signals. The least squares estimate is used to obtain time delay values, which are then used to continuously generate an estimate of a measured depth of the borehole.

17 Claims, 13 Drawing Sheets

FIG. 3B

(58) Field of Classification Search
USPC ..... 340/83
See application file for complete search history.

(56) References Cited

U.S. PATENT DOCUMENTS

| | | | | |
|---|---|---|---|---|
| 2008/0239872 | A1 | 10/2008 | Miller et al. | |
| 2010/0328096 | A1 | 12/2010 | Hache et al. | |
| 2011/0224906 | A1* | 9/2011 | Zhang | G01V 5/04 702/8 |
| 2012/0130693 | A1* | 5/2012 | Ertas | E21B 44/00 703/2 |
| 2015/0131410 | A1 | 5/2015 | Clark | |
| 2015/0292322 | A1 | 10/2015 | Logan et al. | |
| 2016/0266269 | A1 | 9/2016 | Wilson et al. | |
| 2016/0334542 | A1* | 11/2016 | Chiu | G04G 7/00 |
| 2018/0010450 | A1* | 1/2018 | Forstner | E21B 49/005 |

OTHER PUBLICATIONS

International Search Report of the International Searching Authority for PCT/US2018/015612; dated May 9, 2018.

Written Opinion of the International Searching Authority for PCT/US2018/015612; dated May 9, 2018.

Mohammed A. Namuq, Thesis—"Simulation and modeling of pressure pulse propagation in fluids inside drill strings", Geosciences, Geoengineering and Mining of the Technische Universität Bergakademie Freiberg, 2013, pp. 1-114.

Hongtao Li, et al., "Propagation of Measurement-While-Drilling Mud Pulse during High Temperature Deep Well Drilling Operations", Hindawi Publishing Corporation, Mathematical Problems in Engineering, vol. 2013, Article ID 243670, pp. 1-12, 2013.

Björck, A., "Numerical methods for least squares problems," SIAM, Philadelphia, ISBN 0-89871-360-9, 1996, Chapter 9, pp. 342-358.

Fletcher, Roger, "Practical methods of optimization (2nd ed.)," New York: John Wiley & Sons, ISBN 978-0-471-91547-8, 1987, Chapter 3.

Nocedal, Jorge and Wright, Stephen, "Numerical optimization," New York: Springer, ISBN 0-387-98793-2, 1999, Chapter 10, pp. 222-249.

Roland, "Fourier and Wavelet Representations of Functions" in Electronic Journal of Undergraduate Mathematics, 2000, vol. 6, pp. 1-12.

* cited by examiner

SYSTEM FOR DETERMINATION OF MEASURED DEPTH (MD) IN WELLBORES FROM DOWNHOLE PRESSURE SENSORS USING TIME OF ARRIVAL TECHNIQUES

CROSS-REFERENCE TO RELATED APPLICATIONS

The present application is a Non-Provisional patent application of U.S. Provisional Application No. 62/477,344, filed in the United States on Mar. 27, 2017, entitled, "System for Determination of Measured Depth (MD) in Wellbores from Downhole Pressure Using Time of Arrival Techniques" the entirety of which are hereby incorporated by reference.

BACKGROUND OF INVENTION

(1) Field of Invention

The present invention relates to a system for real-time estimation of measured depth (MD) and, more particularly, to a system for real-time estimation of MD from downhole pressure transducer data.

(2) Description of Related Art

Recently, drilling of complicated well trajectories for boreholes has increased. A borehole is a narrow shaft bored in the ground, vertically and/or horizontally, which is constructed for a variety of purposes. There is typically a vertical section from surface, then a curved transition section from vertical to horizontal, and then a horizontal section in the oil and gas reserve. A borehole may be drilled for extraction of water, other liquids (e.g., petroleum) or gases (e.g., natural gas), or as part of a geotechnical investigation, environmental site assessment, mineral exploration, or temperature measurement. Wellbore positioning is described in "Introduction to Wellbore Positioning by Angus Jamieson/UHI Scotland, pages 39-41 and 188 and BP-Amoco Directional Survey Handbook, section 5.2, which are incorporated herein by reference.

In U.S. Pat. No. 4,454,756 (hereinafter referred to as the '756 patent), Sharp described an inertial borehole survey system that required the use of a wireline to provide measured depth (MD) (probe position) information and rate of penetration (ROP) (probe velocity). Signals are sent to the surface for processing to compute and record probe position. Basic Kalman Filtering of survey data and continuous data is done at the surface only after the tool is run. Additionally, the system is intended only for conventional vertical wells, and lacks a high performance magnetometer.

Further, U.S. Pat. No. 4,542,647 (hereinafter referred to as the '647 patent) by Molnar describes a borehole inertial guidance system, that also requires the use of a wireline to provide measured depth (MD) (probe position) information and rate of penetration (ROP) (probe velocity). The system uses only two gyro axes and synthesizes the third axis from either an accelerometer or Earth rate depending on probe velocity. Additionally, the '647 patent describes Basic Kalman Filtering of gyrocompass and INS solutions.

Additionally, the thesis entitled, "Simulation and Modeling of Pressure Pulse Propagation in Fluids Inside Drill Strings" by Mohammed A. Namuq (see http//nbn-resolving.de/urn:nbn:de:bsz:105-qucosa-107969, which is hereby incorporated by reference as though fully set forth herein) was aimed at developing a laboratory experimental setup, a simulation model, and methods for detecting and decoding of measurements while drilling pressure pulse propagation in fluids inside drill strings. The work did not mention estimating MD from such data.

In "Propagation of Measurement-While-Drilling Mud Pulse During High Temperature Deep Well Drilling Operations," (described by Hongtao Li et al., "Propagation of Measurement-While-Drilling Mud Pulse during High Temperature Deep Well Drilling Operations," Mathematical Problems in Engineering, vol. 2013, Article ID 243670, 12 pages, 2013, which is hereby incorporated by reference as though fully set forth herein) an analytical method was developed for propagation of mud pulses. This work also did not discuss correlating the measurement to MD.

Thus, a continuing need exists for estimating MD for mud pulse telemetry systems.

SUMMARY OF INVENTION

The present invention relates to a system for real-time estimation of measured depth (MD) and, more particularly, to a system for real-time estimation of MD from downhole pressure transducer data. The system comprises a drilling fluid pulse telemetry system positioned in a borehole, the drilling fluid pulse telemetry system comprising an environmental sensor package and a drilling fluid pulser; and one or more processors and a non-transitory computer-readable medium having executable instructions encoded thereon such that when executed, the one or more processors perform multiple operations. The system continuously generates an estimate of a measured depth of the borehole based on time series measurements from the environmental sensor package.

In another aspect, in continuously generating an estimate of a measured depth of the borehole, the system continuously obtains time series measurements from the environmental sensor package, the times series measurements comprising source and reflected signals. Initial estimates of a time delay and path attenuation amplitude are determined from the time series measurements. The system determines an L2 error for the initial estimates of the time delay and the path attenuation amplitude. An iterative minimization of the L2 error is performed until a set of source signal parameters converge, resulting in a least squares estimate of the source signal and the reflected signals. The system uses the least squares estimate to obtain time delay values, and using the time delay values, the system continuously generates an estimate of a measured depth of the borehole.

In another aspect, the environmental sensor package comprises a drilling fluid pressure transducer and a drilling fluid temperature sensor.

In another aspect, the time delay values represent a time of flight between acoustic pulses generated by the drilling fluid pulser as measured by the drilling fluid pressure transducer and a received surface echo.

In another aspect, the time delay values are directly correlated with the estimated measured depth of the borehole.

In another aspect, the system estimates arrival times of overlapping signals from a noisy received waveform.

In another aspect, the generated estimate is used to guide a downhole tool to a positional target.

Finally, the present invention also includes a computer program product and a computer implemented method. The computer program product includes computer-readable instructions stored on a non-transitory computer-readable medium that are executable by a computer having one or more processors, such that upon execution of the instructions, the one or more processors perform the operations listed herein. Alternatively, the computer implemented method includes an act of causing a computer to execute such instructions and perform the resulting operations.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
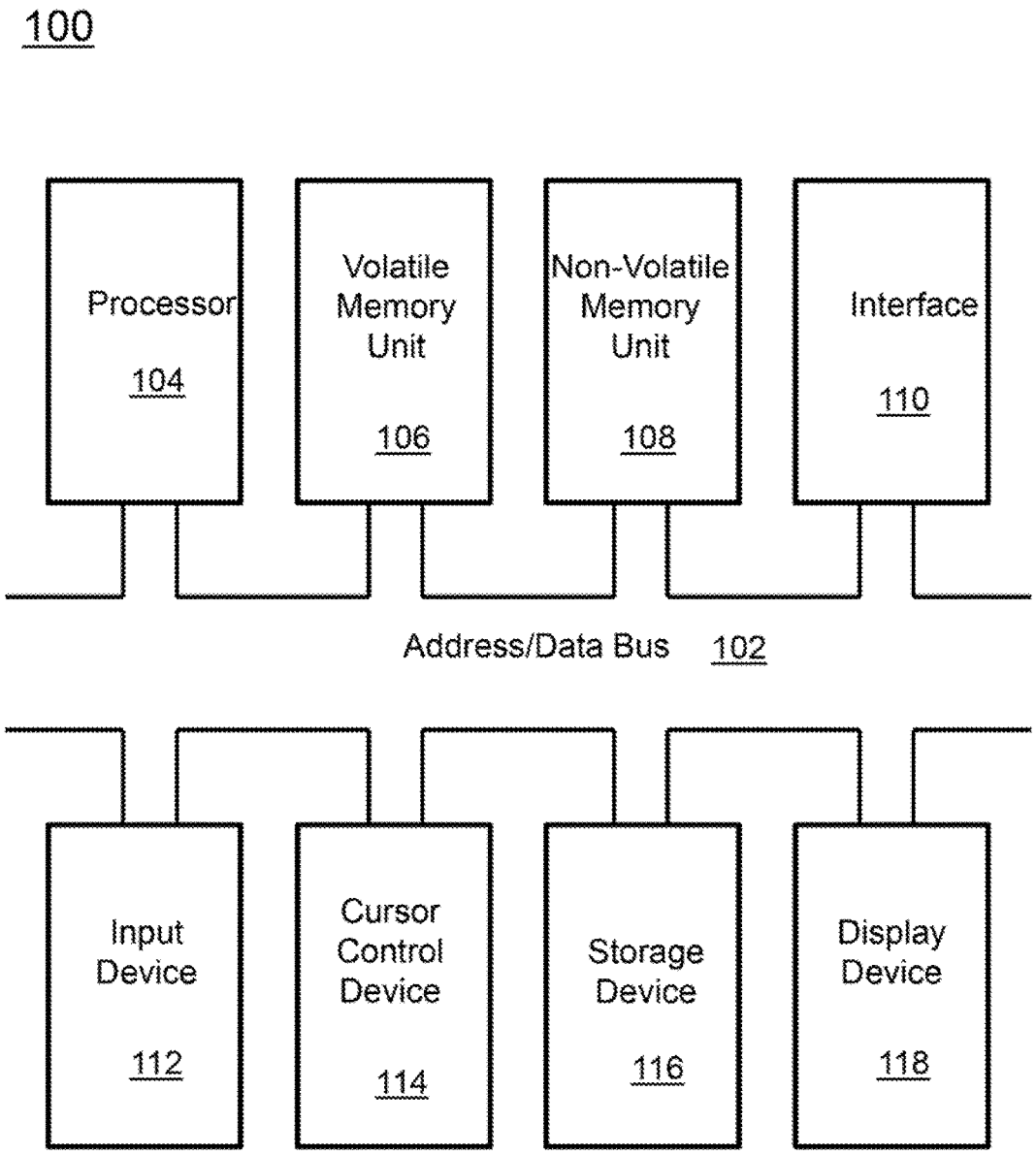
FIG. 1 is a block diagram depicting the components of a system for real-time estimation of measured depth (MID) according to some embodiments of the present disclosure.

The present invention relates to a system for real-time estimation of measured depth (MD) and, more particularly, to a system for real-time estimation of MD from downhole pressure transducer data. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of aspects. Thus, the present invention is not intended to be limited to the aspects presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

(1) Principal Aspects

Various embodiments of the invention include three "principal" aspects. The first is a system for real-time estimation of measured depth (MD). The system is typically in the form of a computer system operating software or in the form of a "hard-coded" instruction set. This system may be incorporated into a wide variety of devices that provide different functionalities. The second principal aspect is a method, typically in the form of software, operated using a data processing system (computer). The third principal aspect is a computer program product. The computer program product generally represents computer-readable instructions stored on a non-transitory computer-readable medium such as an optical storage device, e.g., a compact disc (CD) or digital versatile disc (DVD), or a magnetic storage device such as a floppy disk or magnetic tape. Other, non-limiting examples of computer-readable media include hard disks, read-only memory (ROM), and flash-type memories. These aspects will be described in more detail below.

A block diagram depicting an example of a system (i.e., computer system 100) of the present invention is provided in FIG. 1. The computer system 100 is configured to perform calculations, processes, operations, and/or functions associated with a program or algorithm. In one aspect, certain processes and steps discussed herein are realized as a series of instructions (e.g., software program) that reside within computer readable memory units and are executed by one or more processors of the computer system 100. When executed, the instructions cause the computer system 100 to perform specific actions and exhibit specific behavior, such as described herein.

The computer system 100 may include an address/data bus 102 that is configured to communicate information. Additionally, one or more data processing units, such as a processor 104 (or processors), are coupled with the address/data bus 102. The processor 104 is configured to process information and instructions. In an aspect, the processor 104 is a microprocessor. Alternatively, the processor 104 may be a different type of processor such as a parallel processor, application-specific integrated circuit (ASIC), programmable logic array (PLA), complex programmable logic device (CPLD), or a field programmable gate array (FPGA).

The computer system 100 is configured to utilize one or more data storage units. The computer system 100 may include a volatile memory unit 106 (e.g., random access memory ("RAM"), static RAM, dynamic RAM, etc.) coupled with the address/data bus 102, wherein a volatile memory unit 106 is configured to store information and instructions for the processor 104. The computer system 100 further may include a non-volatile memory unit 108 (e.g., read-only memory ("ROM"), programmable ROM ("PROM"), erasable programmable ROM ("EPROM"), electrically erasable programmable ROM "EEPROM"), flash memory, etc.) coupled with the address/data bus 102, wherein the non-volatile memory unit 108 is configured to store static information and instructions for the processor 104. Alternatively, the computer system 100 may execute instructions retrieved from an online data storage unit such as in "Cloud" computing. In an aspect, the computer system 100 also may include one or more interfaces, such as an interface 110, coupled with the address/data bus 102. The one or more interfaces are configured to enable the computer system 100 to interface with other electronic devices and computer systems. The communication interfaces implemented by the one or more interfaces may include wireline (e.g., serial cables, modems, network adaptors, etc.) and/or wireless (e.g., wireless modems, wireless network adaptors, etc.) communication technology.

In one aspect, the computer system 100 may include an input device 112 coupled with the address/data bus 102, wherein the input device 112 is configured to communicate information and command selections to the processor 100. In accordance with one aspect, the input device 112 is an al alphanumeric input device, such as a keyboard, that may include alphanumeric and/or function keys. Alternatively, the input device 112 may be an input device other than an alphanumeric input device. In an aspect, the computer system 100 may include a cursor control device 114 coupled with the address/data bus 102, wherein the cursor control device 114 is configured to communicate user input information and/or command selections to the processor 100. In an aspect, the cursor control device 114 is implemented using a device such as a mouse, a track-ball, a track-pad, an optical tracking device, or a touch screen. The foregoing notwithstanding, in an aspect, the cursor control device 114 is directed and/or activated via input from the input device 112, such as in response to the use of special keys and key sequence commands associated with the input device 112. In an alternative aspect, the cursor control device 114 is configured to be directed or guided by voice commands.

In an aspect, the computer system 100 further may include one or more optional computer usable data storage devices, such as a storage device 116, coupled with the address/data bus 102. The storage device 116 is configured to store information and/or computer executable instructions. In one aspect, the storage device 116 is a storage device such as a magnetic or optical disk drive (e.g., hard disk drive ("HDD"), floppy diskette, compact disk read only memory ("CD-ROM"), digital versatile disk ("DVD")). Pursuant to one aspect, a display device 118 is coupled with the address/data bus 102, wherein the display device 118 is configured to display video and/or graphics. In an aspect, the display device 118 may include a cathode ray tube ("CRT"), liquid crystal display ("LCD"), field emission display ("FED"), plasma display, or any other display device suitable for displaying video and/or graphic images and alphanumeric characters recognizable to a user.

The computer system 100 presented herein is an example computing environment in accordance with an aspect. However, the non-limiting example of the computer system 100 is not strictly limited to being a computer system. For example, an aspect provides that the computer system 100 represents a type of data processing analysis that may be used in accordance with various aspects described herein. Moreover, other computing systems may also be implemented. Indeed, the spirit and scope of the present technology is not limited to any single data processing environment. Thus, in an aspect, one or more operations of various aspects of the present technology are controlled or implemented using computer-executable instructions, such as program modules, being executed by a computer. In one implementation, such program modules include routines, programs, objects, components and/or data structures that are configured to perform particular tasks or implement particular abstract data types. In addition, an aspect provides that one or more aspects of the present technology are implemented by utilizing one or more distributed computing environments, such as where tasks are performed by remote processing devices that are linked through a communications network, or such as where various program modules are located in both local and remote computer-storage media including memory-storage devices.

Figure 2:
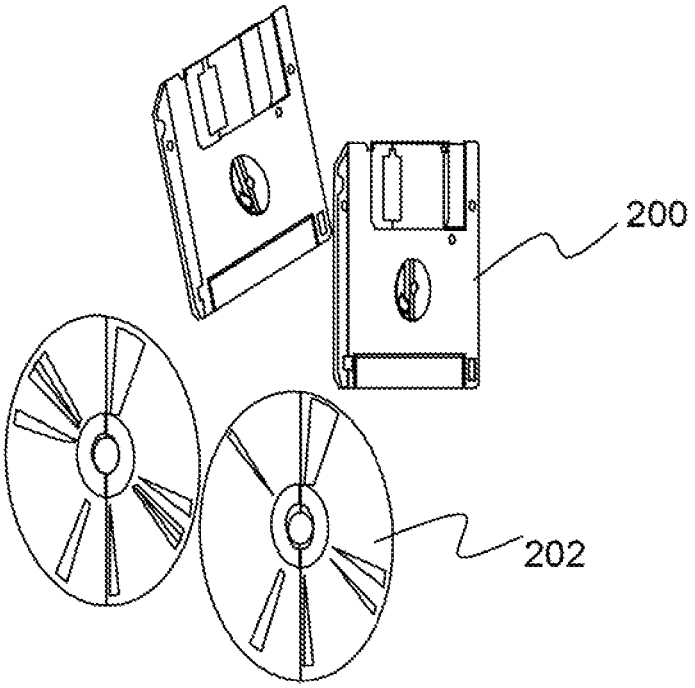
FIG. 2 is an illustration of a computer program product according to some embodiments of the present disclosure.

An illustrative diagram of a computer program product (i.e., storage device) embodying the present invention is depicted in FIG. 2. The computer program product is depicted as floppy disk 200 or an optical disk 202 such as a CD or DVD. However, as mentioned previously, the computer program product generally represents computer-readable instructions stored on any compatible non-transitory computer-readable medium. The term "instructions" as used with respect to this invention generally indicates a set of operations to be performed on a computer, and may represent pieces of a whole program or individual, separable, software modules. Non-limiting examples of "instruction" include computer program code (source or object code) and "hard-coded" electronics (i.e. computer operations coded into a computer chip). The "instruction" is stored on any non-transitory computer-readable medium, such as in the memory of a computer or on a floppy disk, a CD-ROM, and a flash drive. In either event, the instructions are encoded on a non-transitory computer-readable medium.

(2) Specific Details of Various Embodiments

Described is a method and apparatus to estimate the measured depth (MD) or length of a bore hole in real-time from downhole pressure sensors. U.S. Provisional Application No. 62/451,019 entitled, "Opportunistic Sensor Fusion Algorithm for Autonomous Guidance While Drilling" (OSFA) (which is hereby incorporated by reference as though fully set forth herein) described a method for real time localization of the trajectory of an oil wellbore. As described in that disclosure, a key parameter which enables very accurate estimation of wellbore trajectory through the additional algorithms is Measured Depth (MD). MD is a distance traveled or path length (i.e., the amount of drill pipe that has been connected in a drill string). The method according to embodiments of the present disclosure is to estimate the arrival time of flight of the mud pulses from downhole-to-uphole and back by processing the downhole pressure transducer data. The received pressure pulses, or waveforms, collected by the downhole pressure transducer are considered to be scaled and delayed replicas of the input transient signals with noise. The developed algorithm uses least square estimates of amplitude and time delay of each path in a multipath environment. Multipath and noise is present due reflections from drill bit, changes in diameter of the pipes, hydraulic noise, and actuator system noise among other sources. A unique aspect of the method is computation of the time delay and correlating it to measured depth.

The invention described herein allows real-time estimation of MD from downhole pressure transducer data. One known method used in the industry includes transmitting MD directly to the downhole tool from the rig surface using wired drill-pipes. This method is very costly, and there is no surface to downhole tool communication of MD. Another prior method is counting the number of pipe connections and keeping a tally. As a non-limiting example, each pipe is approximately 90 feet in length. As can be appreciated by one skilled in the art, the pipe can be standardized to an arbitrary length, provided that the length is consistent within a drilling run. Then, the MD will approximately be equal to the number of pipes inserted into the drill string multiplied by the length of each pipe. As will be described in further detail below, this estimate is useful mainly in Survey Mode of the invention, which can then be combined with the Continuous Mode navigation solution of the invention. The use of a mud pressure sensor gives an independent measurement. The mud pulse pressure sensor measurement data obtained using the system described herein can be used in conjunction with the Opportunistic Sensor Fusion Algorithm (OSFA) for Autonomous Guidance While Drilling (AGWD) system for achieving >3× improvement, in residual positional uncertainty as well as estimating MD.

Figure 3A:
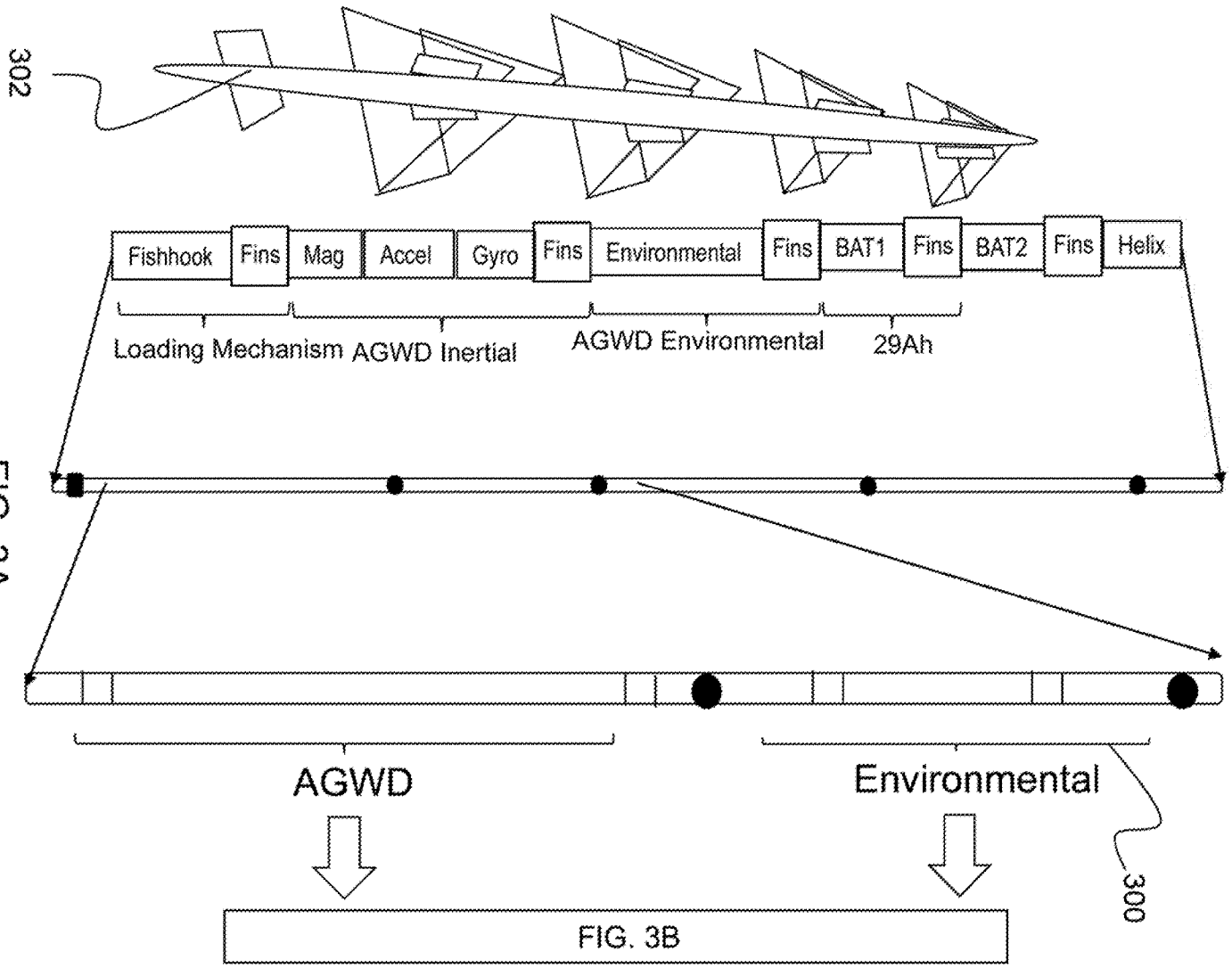
FIG. 3A is an illustration of the opportunistic sensor fusion algorithm (OSFA) for the autonomous guidance while drilling (AGWD) system, including a physical apparatus, according to some embodiments of the present disclosure.

FIGS. 3A-3D show a high level overview of the AGWD system with one of the key blocks being the Determination of MD. The downhole pressure sensor is part of the Environmental Sensor Package 300 along with a temperature transducer and is in contact with the circulating drilling fluid (referred to as the "mud"). The system comprises a physical apparatus and a system algorithm which runs on embedded computing hardware in the physical apparatus. An illustration of an example physical apparatus, a AGWD apparatus 302, is shown in FIG. 3A. In one embodiment, the AGWD apparatus 302 is in the form of a standalone downhole probe or sonde which is encased in a Copper-Beryllium pressure vessel to withstand the extreme pressures (up to 20,000 pounds per square inch (PSI)) in the drilling environment.

Figure 3B:
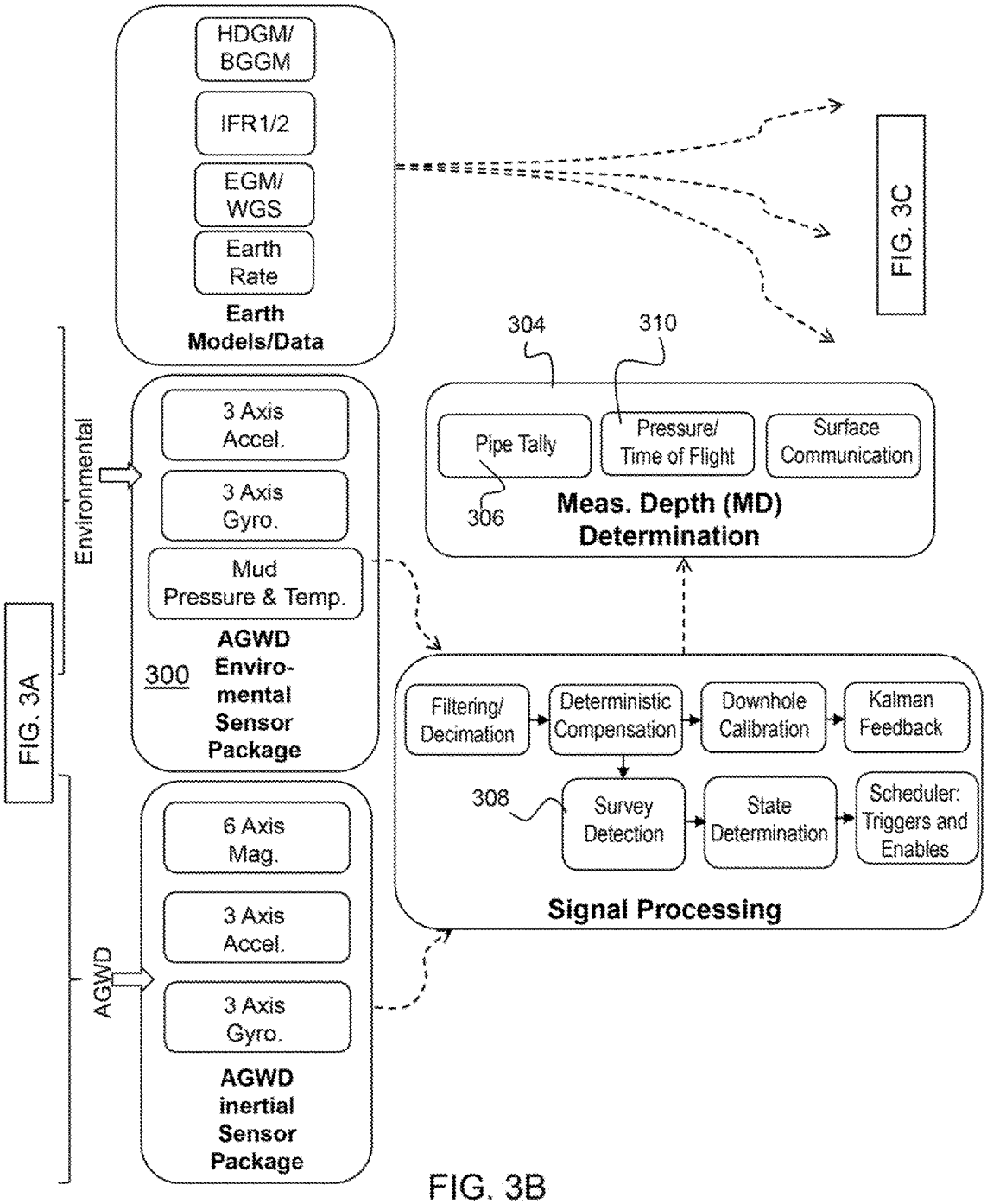
FIG. 3B is an illustration of the OSFA for the AGWD system, including an environmental sensor package, an inertial sensor package, signal processing, and measured depth determination, according to some embodiments of the present disclosure.
Figure 3C:
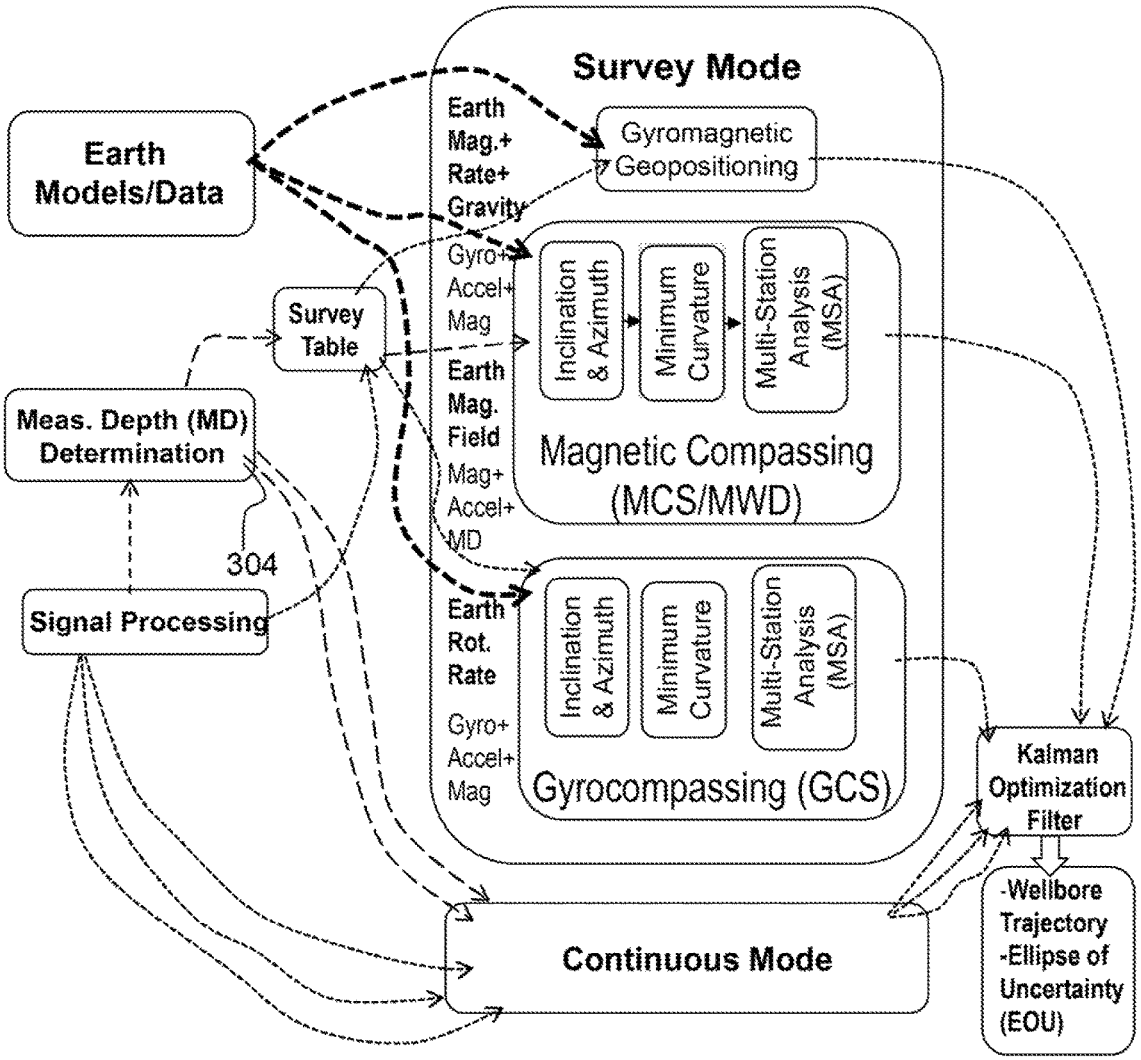
FIG. 3C is an illustration of the OSFA for the AGWD system, including a detailed depiction of the survey mode, according to some embodiments of the present disclosure.
Figure 3D:
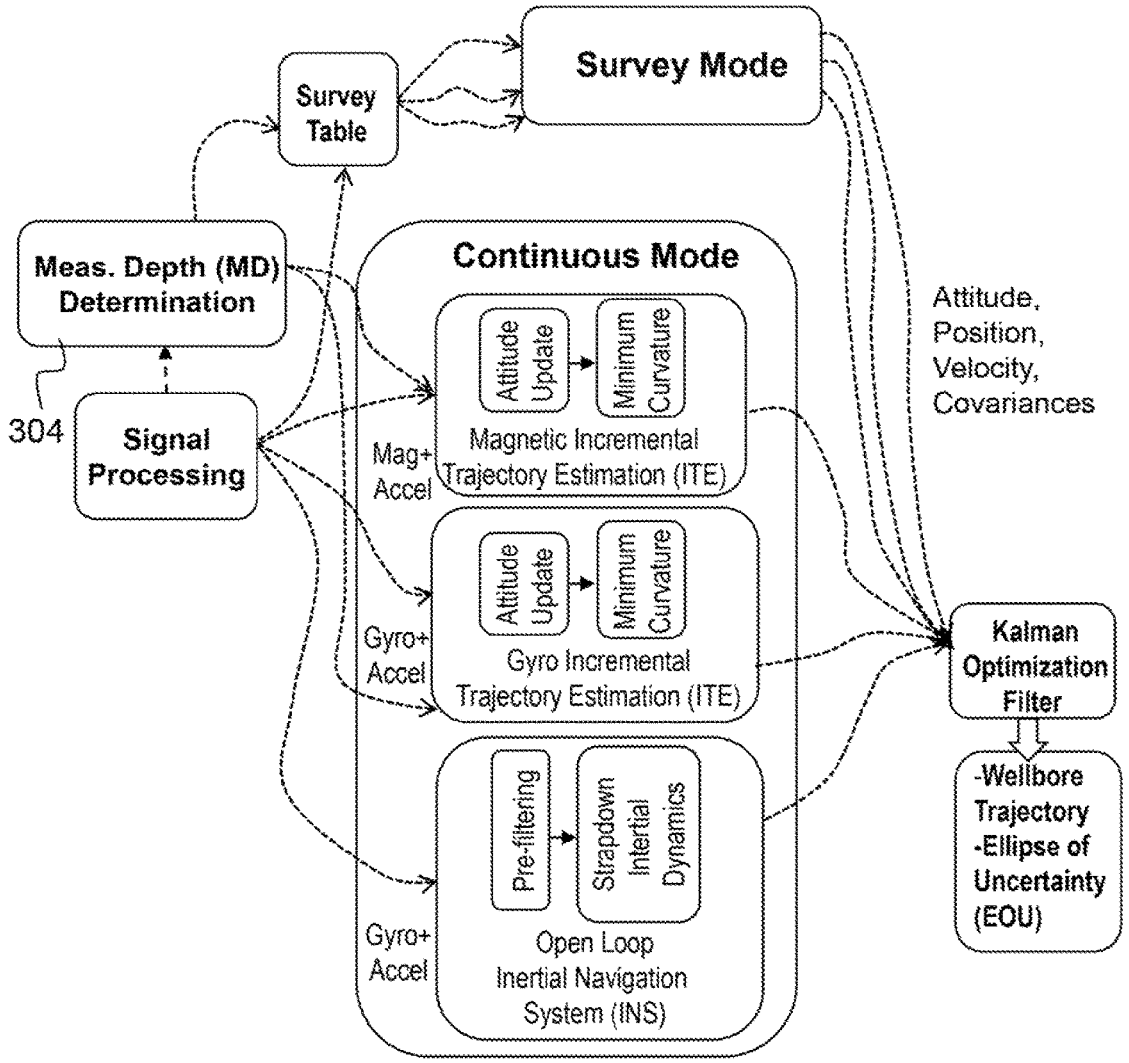
FIG. 3D is an illustration of the OSFA for the AGWD system, including a detailed depiction of the continuous mode, according to some embodiments of the present disclosure.
Figure 4:
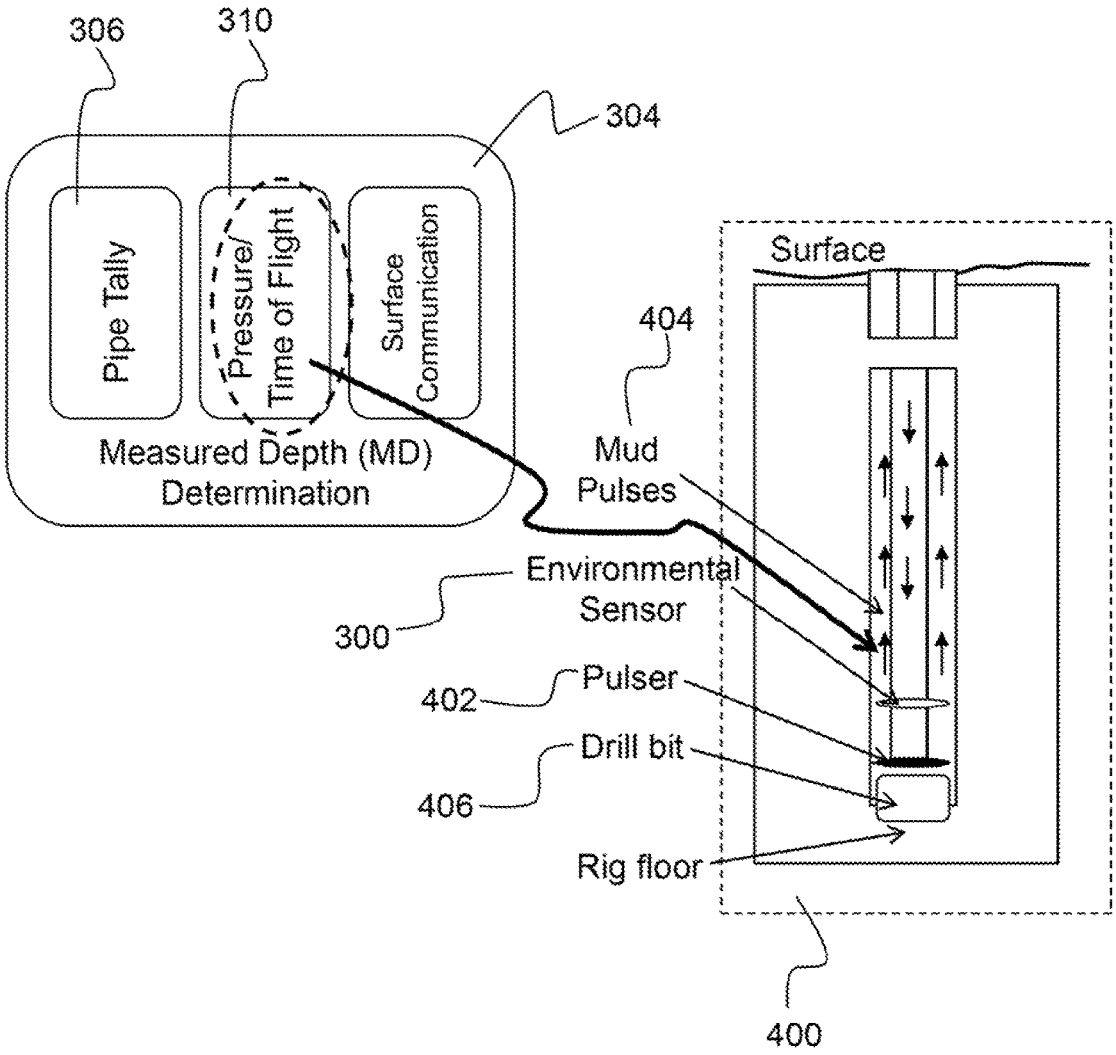
FIG. 4 is an illustration of the MD determination block in the AGWD system and the typical mud pulse telemetry system according to some embodiments of the present disclosure.

A key parameter which enables very accurate estimation of wellbore trajectory through the additional algorithms is downhole measured depth (MD) determination (element 304 in FIGS. 3B-3D). This is essentially the amount of drill pipe that has been connected in a drill string, so it is very easy to measure at the surface from the drilling rig, as is often done in the prior art. The measured depth (distance traveled or path length in non-drilling applications) determination block (element 304) which performs multiple operations. For instance, a basic pipe tally (element 306) is performed by counting the number of detected pipe connections and multiplying by the typical or average pipe length (e.g., through use of the survey detection block (element 308) when a sufficiently quiet period has been detected (sensor standard deviations below a certain threshold depending on the type of sensor) and/or through the use of the INS (Inertial Navigation System) to detect motion profiles. Determination. of measured depth can also be performed by analyzing the time of flight (element 310) between acoustic pulses generated by the downhole mud pulser 402 as measured by the environmental sensor package 300 mud pressure transducer and the received surface echo as illustrated in FIG. 4. The surface echo is detected through a receiver (pressure transducer) uphold/surface coupled with a demodulator.

FIG. 4 depicts the MD determination block (element 304) and a typical mud sensor configuration 400 according to embodiments of the present disclosure. The environmental sensor package 300 that holds the pressure transducer sits ~30 feet above the pulser 402 that generates the mud pulse 404. In the typical case, the mud pressure pulses travel along the inside of the drill pipe (indicated by the downward flow arrows in FIG. 4). Only in some configurations are the mud pressure pulses sent via the upward flow between the outside of the drill pipe and the raw rock walls of the borehole (represented by the upward flow arrows in FIG. 4). This is because the mud flow past the rotating drill bit 406 at the bottom of the drillstring introduces considerable turbulence into the mud flow, which would be considered noise in the system described herein. The environmental sensor package 300 acquires data from high range, lower precision sensors at 1000 Hz. A drill bit 406 is positioned at the bottom of the mud sensor configuration 400 near the rig floor. The environmental sensor package 300 comprises the drilling fluid ("mud") pressure transducer as well as a mud temperature sensor. An appropriate number of analog to digital converters and companion microcontrollers are used to acquire the sensor signals and convert them to digital data streams which can be distributed for further processing (at a rate of at least 1000 samples per second for each environmental sensor stream). Additionally, one (or more) embedded processor(s) (which could be implemented as a microcontroller, a digital signal processor, or a field-programmable gate array (FPGA)) execute the algorithm described herein to compute the measured depth.

Time delay estimation procedures are used in a number of disciplines, such as in radar, sonar, biomedical, and geophysical signal processing. The underlying idea that is common is that reflections of a linearly propagated signal are essentially scaled replicas of the original signal with some time delay and noise. Reflection from pressure release interfaces (waves traveling from mud towards air) can cause a 180 phase shift that is not seen across other interfaces with larger acoustic impedances. Numerical methods exist wherein a received signal from an assumed set of reflection paths is used to predict mutual time delays with minimal assumptions on the frequency content of the source. Indeed, these methods have been demonstrated to work with or without a precise knowledge of the source signal itself. Rather, a class of signals is assumed, (such as continuous or gated sinusoids, rectangular pulses), which can be described by a small set of constant parameters. A typical received pulse r(t) can be represented as shown below where, S(t) is the transmitted signal, $\tau_k$ is the time delay, $\alpha_k$ is the path attenuation amplitude, M are the different paths (i.e., paths with multiple reflections that have different time delays), and n(t) is the inevitable noise.

$$r(t)=\Sigma_{k=1}^{M}\alpha_k S(t-\tau_k)+n(t).$$

Figure 5A:
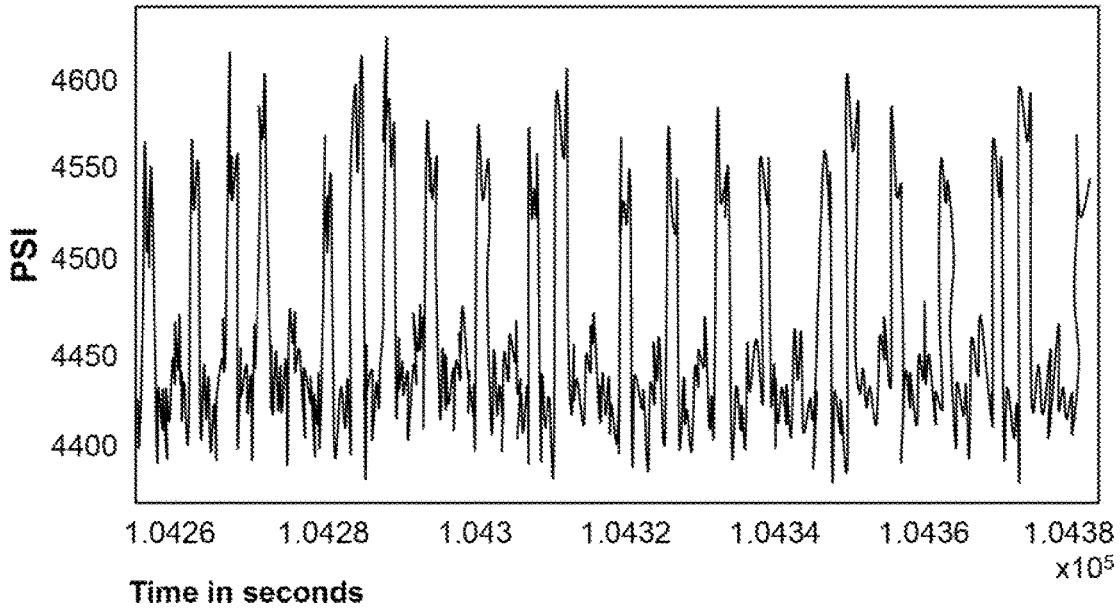
FIG. 5A is a plot illustrating typical received waveforms from mud pressure sensors according to some embodiments of the present disclosure.
Figure 5B:
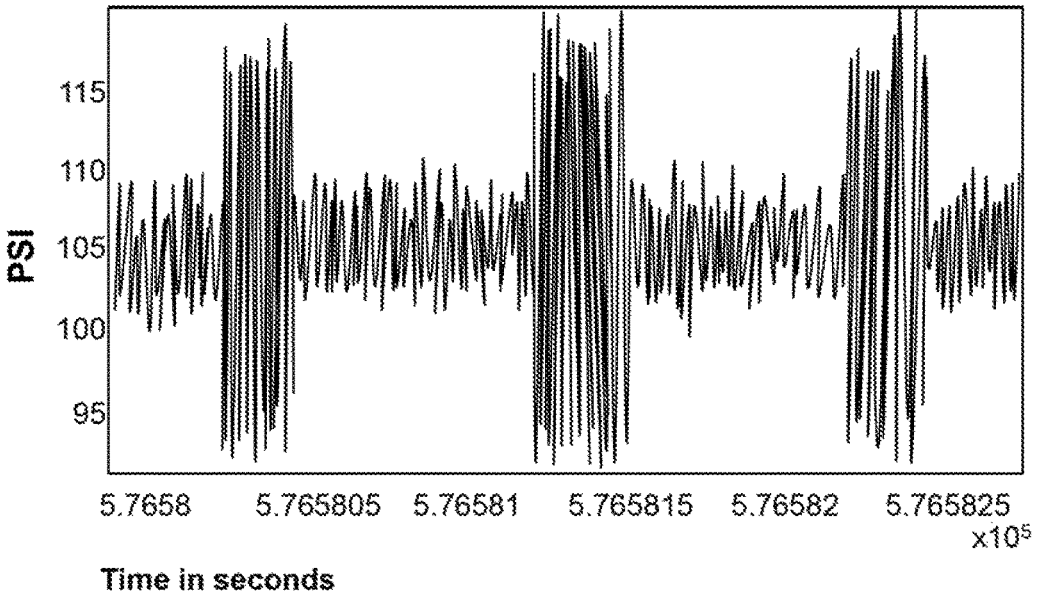
FIG. 5B is a plot illustrating typical received waveforms from mud pressure sensors according to some embodiments of the present disclosure.

The time series measurements are made at a given location, which consists of source and (multiple) reflected signals. Non-limiting examples of received waveforms from downhole pressure sensors are shown in FIGS. 5A and 5B. The transmitted waveform need not be known precisely. They could belong to a parameter class such as pulsed gated sinusoids, continuous sinusoid, and rectangular pulses typically seen in mud pulse telemetry systems. Measured temperature values can also be used to calculate a distribution of the speed of sound, such that from a given location, the path length of the propagating acoustic waves can be made precisely. Three different wave forms: pulsed gated sinusoids, continuous sinusoid, and rectangular pulse can be used as reference signals. Mad pulse systems are known to send pressure fluctuations through the drilling fluid that can vary, such as positive mud telemetry, and negative or continuous mud siren. A mud siren style of a measurement-while-drilling pulser uses a pulse waveform that can be shifted towards a higher frequency before transmission. They can also be encoded for them to be decoded at the surface and translated to usable data. Measured pressure data is analyzed using these reference signal types, with a simple FFT to guide the algorithms in locating dominant frequencies. Time delays computed from here are then correlated with actual depth, which is a strong correlation leading to model verification and deployment in a real-time signal processing toolkit. Time delays represent the round trip delay.

Figure 6A:
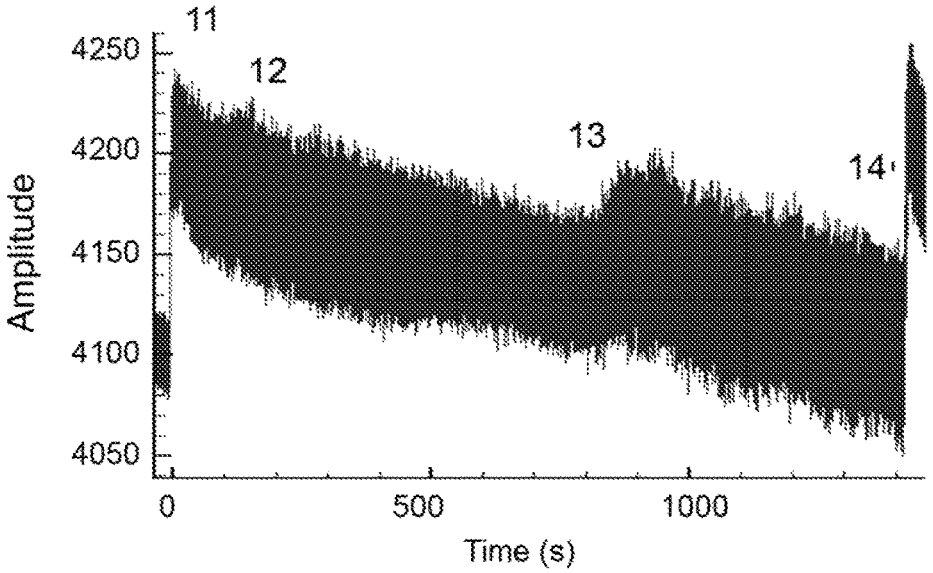
FIG. 6A is an illustration of time domain local sections of the received waveforms according to some embodiments of the present disclosure.
Figure 6B:
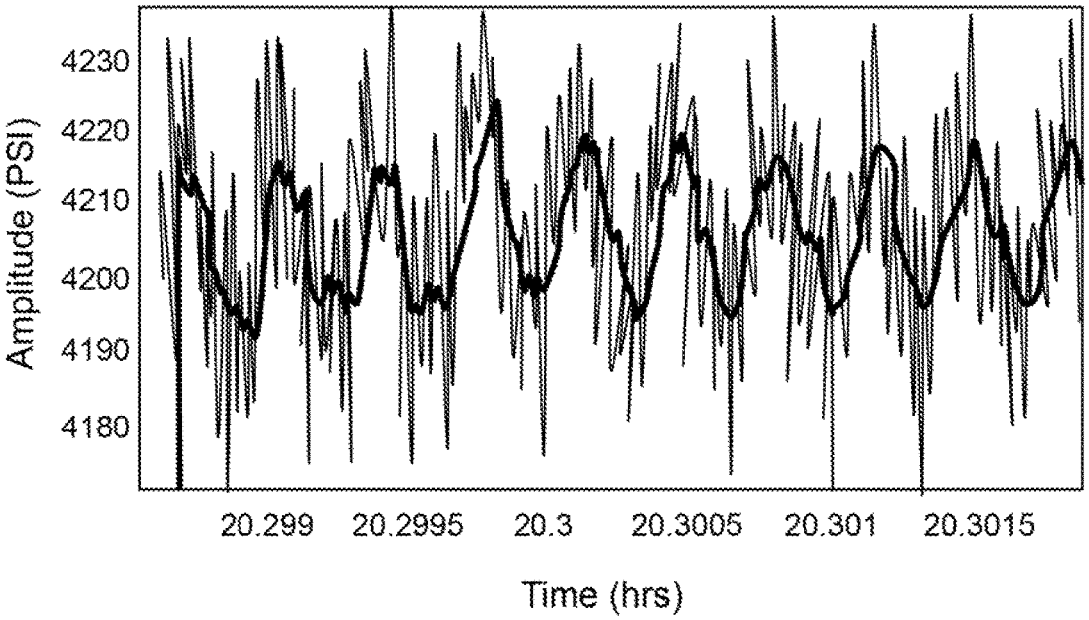
FIG. 6B is an illustration of filtering the high frequency content according to some embodiments of the present disclosure.
Figure 6C:
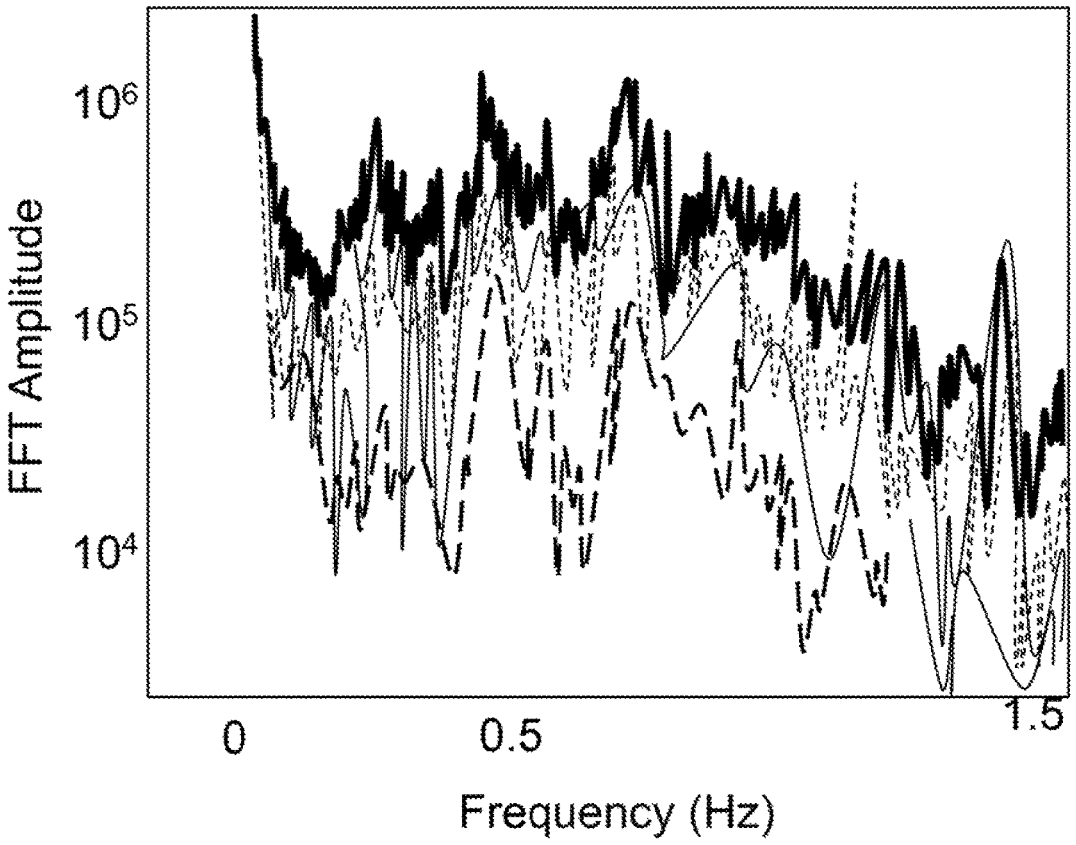
FIG. 6C is an illustration of frequency domain data from different time sections to identify the dominant frequency according to some embodiments of the present disclosure.

FIGS. 6A-6E depict a generic example of the steps described above. FIG. 6A is a plot illustrating time domain local sections of the received waveform. The numbers 11, 12, 13, and 14 refer to local sections of the time domain data of the pressure pulses. FIG. 6B is a plot depicting filtering the high frequency content, where the unbolded line represents an original signal, and the bold line represents a reconstructed signal. FIG. 6C is a plot showing frequency domain data from different time sections to identify the dominant frequency, wherein each line represents frequency domain data of a local section.

Figure 6D:
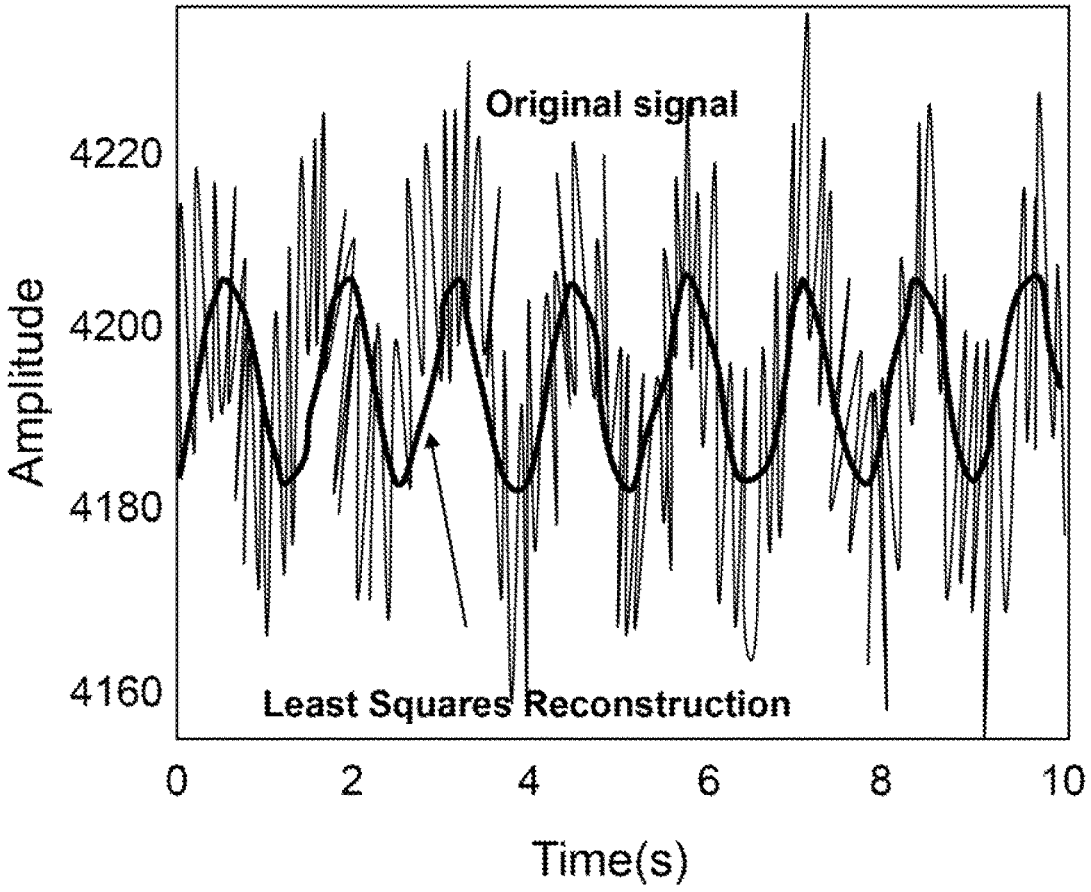
FIG. 6D is an illustration of a reconstructed signal using least squares according to some embodiments of the present disclosure.

FIG. 6D illustrates a reconstructed signal using least squares, where the unbolded line represents an original signal, and the bold line represents a reconstructed signal. The following are sample calculations at 0.77 Hz.

$$\xi = \propto + A\cos(\omega t) + B\sin(\omega t) + \varepsilon$$
$$= \propto + R\cos(\omega t + \varphi) + \varepsilon$$

Note the following equivalence:

$$\xi = \propto + A\cos(\omega t) + B\cos(\omega t + \varphi) + \varepsilon$$
$$= \propto + A'\cos(\omega t) + B'\sin(\omega t) + \varepsilon$$

where $A' = A + B\cos(\varphi)$ $B' = -B\sin(\varphi)$.

Figure 6E:
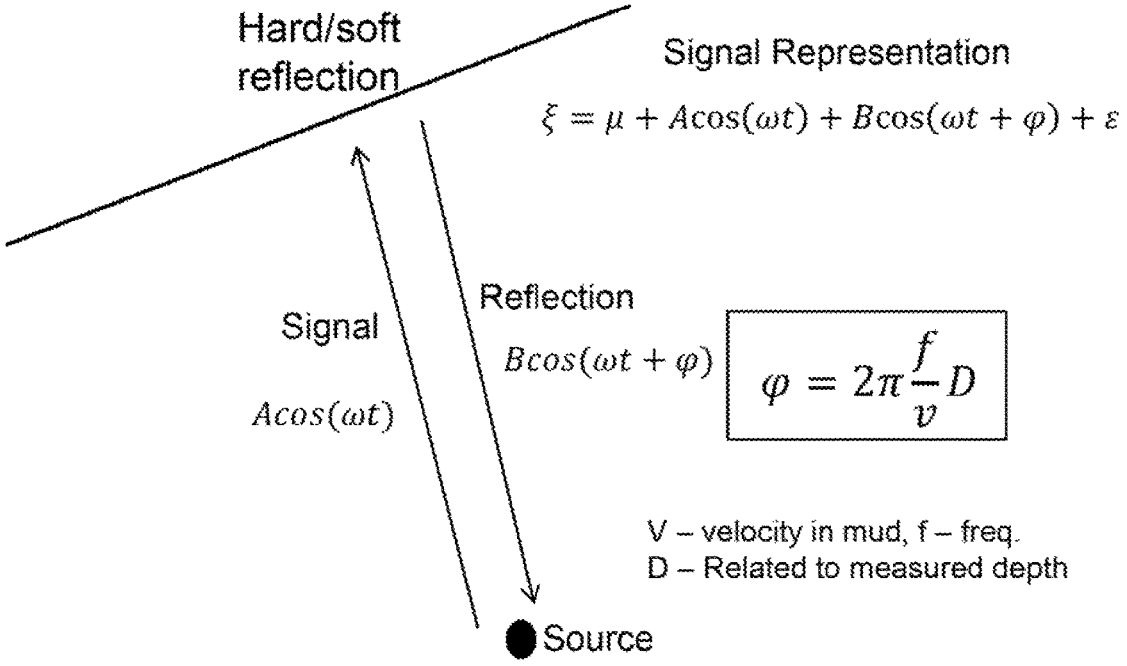
FIG. 6E is an illustration of a generic signal representation and relation to depth according to some embodiments of the present disclosure.

The sample calculation with the following values is used to illustrate the terms in FIG. 6E. Experimental results show that, as the phase changes, there is an increase in depth.

$\omega = 2\pi f = 2\pi \times 0.77$ $\propto = 4133.9$ $A = 7.093$ $B = -=3.8413$ $\varphi \approx 180°$ $D = 3190$ ft FIG. 6E depicts a generic signal representation and relation to measured depth (MD). The time delay obtained is related to depth by the equation in FIG. 6E. As one moves in time, one should see a longer time delay (or phase shift) and increase in depth (MD). The signal representation is determined according to the following:

$$\xi = \mu + A\cos(\omega t) + B\cos(\omega t + \varphi) + \varepsilon$$
$$= \mu + A'\cos(\omega t) + B'\sin(\omega t) + \varepsilon$$

A and B are the amplitudes of the wave (e.g., mud pulse) towards the surface and the return signal from the surface, respectively. $\varphi$ denotes a time delay of the reflected signal, $\mu$ is an average amplitude of the signal around which the sine-wave oscillates, and $\varepsilon$ represents additive noise. The goal is to detect the phase shift and relate it to the MD.

Figure 7:
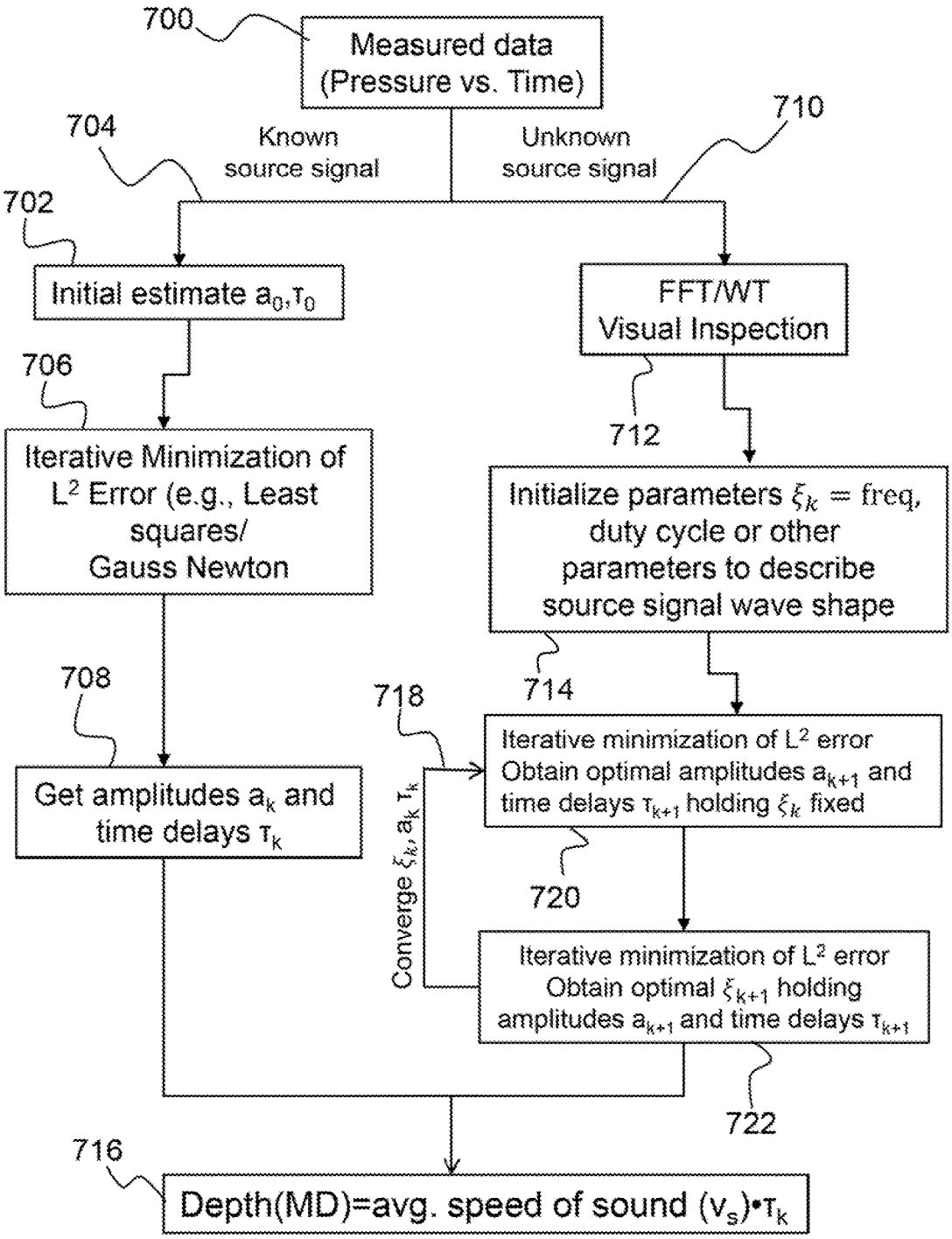
FIG. 7 is a flow diagram illustrating real-time estimation of MD according to some embodiments of the present disclosure.

FIG. 7 is a flow diagram illustrating the method described herein. The system described herein estimates the arrival times of overlapping signals from a noisy received waveform.

$$r(t) = \sum_{k=1}^{M} a_k S(t - \tau_k) + n(t).$$

Given measured data 700 (pressure vs, time), initial estimates 702 of the parameters describing the signal, such as the frequency, duration, time delay values, pulse width, and amplitude (e.g., initial values of amplitudes and time delays) of a known source signal 704. The problem is posed in the frequency domain, where delays in time are represented by multiplication by exponential factors. An L2 error is formulated based on the sum of the square of the differences between observed and expected discrete time values. Least squares minimization of this error 706 leads to a set of nonlinear equations, which must be solved to obtain the time delay values ($\tau$) and received signal amplitudes (a) (element 708). These are the iterated values of amplitudes and delays for all of the signals. Each of these is computed using an iterative Gauss-Newton algorithm. Least squares minimization is described by Björck, A. in "Numerical methods for least squares problems," SIAM, Philadelphia, ISBN 0-89871-360-9, 1996. Multiple optimization methods are disclosed by Fletcher, Roger in Practical methods of optimization (2nd ed.), New York: John Wiley & Sons, ISBN 978-0-471-91547-8, 1987 and by Nocedal, Jorge and Wright, Stephen in Numerical optimization. New York: Springer, ISBN 0-387-98793-2, 1999, which are hereby incorporated by reference as though fully set forth herein.

Based on this result, the assumed source signal parameters from an unknown source signal. 710 guided by FFT/WT (fast Fourier transform/wavelet transform) visual inspection 712 (pre-processing step) are updated using an iterative process. Parameters are initialized to describe the source signal wave shape (element 714). The parameters are for the source waveform. This is unknown, but the method begins with an initial guess. Visual inspection would typically be done the first time a new type of mud pulser is encountered based on a recorded data set to turn an unknown source (element 710) into a known source (element 704). However, if the full generic signal is allowed in terms of a linear combination of sine waves or a linear combination of wavelets, then the visual inspection would be optional.

A measured depth (MD) solution (element 716) converges when the source signal parameters converge (element 718), at which point there is a least squares accurate estimate of the source as well as all of the reflected signals. The MD is equal to the speed of sound multiplied by the time delay (main path excluding the multipath delays). To find which "path" is "tracking" depth, take the average speed when the velocity of sound varies with temperature.

Iterative minimization of L2 error is used to obtain optimal amplitudes $a_k$+1 and time delays $\tau_k$+1, holding $\xi_k$ fixed (element 720). Iterative minimization of L2 error is used to obtain optimal $\xi_{k+1}$ holding amplitudes $a_{k+1}$ and time delays $\Sigma_{k+1}$ fixed (element 722). The iterative process can be initiated by assuming each of three source signal shapes and parameters, guided by FFT, visual observations of the data, or by a direct user input (element 712).

The path for the known source signal 704 is the path normally taken in downhole operation. The path taken for the unknown source signal 710 is a generic algorithm in which the mathematical form of the signal S(t−τk) is unknown, so one would represent it in a generic form, such as a linear combination of sinusoidal waves or a linear combination of wavelets (for additional details, refer to "Fourier and Wavelet Representations of Functions" by Roland in Electronic Journal of Undergraduate Mathematics, Vol. 6, pgs. 1-12, 2000, which is hereby incorporated by reference as though fully set forth herein). Typically, one would know the mud pulser type, and therefore, know the mathematical form of $S(t-\tau_k)$, so one would follow the known source signal 704 path. The unknown source signal 710 path would be followed if the known source signal 704 path is not successful at obtaining a measured depth estimate. Additionally, the unknown source signal 710 path would be followed if one doesn't know in advance what type of mud pulser is being used. If a new type of mud pulser is being encountered for the first time, one could use the unknown source signal 710 path to determine the form of $S(t-\tau_k)$ for that type of mud pulser, after which the known source signal 704 path would be taken for subsequent runs. The known source signal 704 path would typically be more computationally efficient than the unknown source signal 710 path.

As can be appreciated by one skilled in the art, existing techniques provide no economic way to estimate MD in a continuous mode. The '756 patent requires the use of a wireline to provide MD (probe position) information and rate of penetration (ROP) (probe velocity). Furthermore, the '647 patent also requires the use of a wireline to provide MD information and ROP. In contrast, the invention described herein uses mud pressure pulser time of flight to determine MD so that the wireline is eliminated.

The impact of the disclosed method will be substantial for the oil and gas industry if implemented industry, wide. Errors in determination of the borehole depth can lead to corrupt logging data. In addition, knowing the measured depth along the wellbore allows for proper orientation and functionality of the downhole tool in order to guide the downhole tool to its geological and/or positional target, during wellbore operations to estimate whether the selected trajectory is being maintained. Additionally, the invention described herein is applicable to products such as underground navigation/surveillance, unmanned aerial, and underwater vehicles.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A system for estimating measured depth of a borehole, the system comprising:

a drilling fluid pulse telemetry system positioned in a borehole, the drilling fluid pulse telemetry system comprising an environmental sensor package and a drilling fluid pulser; and one or more processors and a non-transitory computer-readable medium having executable instructions, which when executed, cause the one or more processors to perform operations of:

continuously obtaining time series measurements from the environmental sensor package, the times series measurements comprising source signals and reflected signals;

determining initial estimates of a time delay and path attenuation amplitude from the time series measurements;

determining an L2 error for the initial estimates of the time delay and the path attenuation amplitude;

performing iterative minimization of the L2 error until a set of source signal parameters converge, resulting in a least squares estimate of the source signal and the reflected signals;

using the least squares estimate to obtain time delay values; and using the time delay values to continuously generate an estimate of a measured depth of the borehole.

2. The system as set forth in claim 1, wherein the environmental sensor package comprises a drilling fluid pressure transducer and a drilling fluid temperature sensor.

3. The system as set forth in claim 2, wherein the time delay values represent a time of flight between acoustic pulses generated by the drilling fluid pulser as measured by the drilling fluid pressure transducer and a received surface echo.

4. The system as set forth in claim 1, wherein the time delay values are directly correlated with the estimated measured depth of the borehole.

5. The system as set forth in claim 1, wherein the one or more processors further perform an operation of estimating arrival times of overlapping signals from a noisy received waveform.

6. The system as set forth in claim 1, wherein the generated estimate is used to guide a downhole tool to a positional target.

7. A computer implemented method for estimating measured depth of a borehole, comprising an act of causing one or more processors to execute instructions stored on a non-transitory memory such that upon execution, the one or more processors perform operations of:

continuously obtaining time series measurements from an environmental sensor package, the times series measurements comprising source signals and reflected signals;

determining initial estimates of a time delay and path attenuation amplitude from the time series measurements;

determining an L2 error for the initial estimates of the time delay and the path attenuation amplitude;

performing iterative minimization of the L2 error until a set of source signal parameters converge, resulting in a least squares estimate of the source signal and the reflected signals;

using the least squares estimate to obtain time delay values; and using the time delay values, continuously generating an estimate of a measured depth of the borehole.

8. The method as set forth in claim 7, wherein the environmental sensor package comprises a drilling fluid pressure transducer and a drilling fluid temperature sensor.

9. The method as set forth in claim 8, wherein the time delay values represent a time of flight between acoustic pulses generated by the drilling fluid pulser as measured by the drilling fluid pressure transducer and a received surface echo.

10. The method as set forth in claim 7, wherein the time delay values are directly correlated with the estimated measured depth of the borehole.

11. The method as set forth in claim 7, wherein the one or more processors further perform an operation of estimating arrival times of overlapping signals from a noisy received waveform.

12. The method as set forth in claim 7, wherein the generated estimate is used to guide a downhole tool to a positional target.

13. A computer program product for estimating measured depth of a borehole, the computer program product comprising:

computer-readable instructions stored on a non-transitory computer-readable medium that are executable by a computer having one or more processors for causing the processor to perform operations of:

continuously obtaining time series measurements from an environmental sensor package, the times series measurements comprising source signals and reflected signals;

determining initial estimates of a time delay and path attenuation amplitude from the time series measurements;

determining an L2 error for the initial estimates of the time delay and the path attenuation amplitude;

performing iterative minimization of the L2 error until a set of source signal parameters converge, resulting in a least squares estimate of the source signal and the reflected signals;

using the least squares estimate to obtain time delay values; and using the time delay values, continuously generating an estimate of a measured depth of the borehole.

14. The computer program product as set forth in claim 13, wherein the environmental sensor package comprises a drilling fluid pressure transducer and a drilling fluid temperature sensor.

15. The computer program product as set forth in claim 14, wherein the time delay values represent a time of flight between acoustic pulses generated by the drilling fluid pulser as measured by the drilling fluid pressure transducer and a received surface echo.

16. The computer program product as set forth in claim 13, wherein the time delay values are directly correlated with the estimated measured depth of the borehole.

17. The computer program product as set forth in claim 13, further comprising instructions for causing the one or more processors to further perform an operation of estimating arrival times of overlapping signals from a noisy received waveform.

* * * * *